US005205360A

United States Patent [19]

Price

[11] Patent Number: 5,205,360

[45] Date of Patent: Apr. 27, 1993

[54] PNEUMATIC WELL TOOL FOR STIMULATION OF PETROLEUM FORMATIONS

[75] Inventor: Billy F. Price, Houston, Tex.

[73] Assignee: Price Compressor Company, Inc., Houston, Tex.

[21] Appl. No.: 753,091

[22] Filed: Aug. 30, 1991

[51] Int. Cl.[5] ..... E21B 43/26

[52] U.S. Cl. ..... 166/308; 166/63

[58] Field of Search ..... 166/308, 63, 177, 299; 175/56; 367/144–146; 299/13

[56] References Cited

U.S. PATENT DOCUMENTS

| | | | |
|---|---|---|---|
| 3,209,834 | 10/1965 | Essary | 166/177 |
| 3,674,093 | 7/1972 | Reese | 166/63 X |
| 3,825,071 | 7/1974 | Veatch, Jr. | 166/308 |
| 4,064,935 | 12/1977 | Mohaupt | 166/63 |
| 4,682,309 | 7/1987 | Dedole et al. | 367/146 |
| 4,683,943 | 8/1987 | Hill et al. | 166/63 |
| 4,697,255 | 9/1987 | Howlett | 367/146 |
| 4,718,493 | 1/1988 | Hill et al. | 166/63 X |
| 4,775,016 | 10/1988 | Barnard | 175/56 |
| 4,798,244 | 1/1989 | Trost | 166/299 X |
| 4,823,875 | 4/1989 | Hill | 166/63 X |
| 4,823,876 | 4/1989 | Mohaupt | 166/63 X |
| 4,903,772 | 2/1990 | Johnson | 166/299 |
| 4,967,840 | 11/1990 | Miller | 166/63 X |
| 4,997,044 | 3/1991 | Stack | 166/63 X |
| 5,005,641 | 4/1991 | Mohaupt | 166/63 |

*Primary Examiner*—Ramon S. Britts
*Assistant Examiner*—Roger J. Schoeppel
*Attorney, Agent, or Firm*—Pravel, Hewitt, Kimball & Krieger

[57] ABSTRACT

A pneumatic well tool for fracturing or enlarging perforations in a subsurface formation so that the petroleum in the formation more freely flows. The tool takes the form of an elongate tool body or sonde which is lowered by a wireline into the well bore to a desired depth adjacent the formation of interest. A fluid chamber in the sonde in fluid communication with the fluid in the well bore is filled with a quantity of well bore fluid. Periodically, a pneumatic pressure source in the sonde exerts pressure on the fluid chamber to force fluid from the chamber into the well bore, thus creating a sudden pressure surge which increases the ability of fluid to flow from the perforated formation.

7 Claims, 1 Drawing Sheet

PNEUMATIC WELL TOOL FOR STIMULATION OF PETROLEUM FORMATIONS

FIELD OF THE INVENTION

The present invention relates generally to oil field production equipment. More specifically, the present invention provides an improved system for pneumatically stimulating fluid flow in a petroleum formation adjacent a well bore.

BACKGROUND

Many oil and gas wells are drilled in "tight" formations having a very low permeability which limits the flow of fluid from them. A number of prior art techniques have been developed to increase the production of petroleum from such tight formations. In general, these prior art production enhancement techniques include various uses of explosives, chemicals, or hydraulic pressure fracturing to increase fluid flow in the geologic formation. Common explosive techniques include nitro shooting and bullet perforations. Chemical techniques include the use of acids, organic solvents, and surfactants.

Most prior art hydraulic fracturing techniques involve some form of injection of fluid into the well bore under sufficient pressure to cause the formation in question to fracture. One of the problems with prior hydraulic fracturing techniques, however, is the inability to repeatedly deliver forces needed to increase the amount of formation fracture at a desired depth within the well.

SUMMARY OF THE INVENTION

The present invention provides a new and improved pneumatic well tool which assists in fracturing or enlarging the pores of a formation to promote more free flow of petroleum from the formation into the well bore. The preferred embodiment of the tool comprises an elongate metallic tool body or sonde which is lowered by a wireline into the well bore to a desired depth adjacent a perforation formed in the formation of interest. A fluid chamber in the sonde in fluid communication with the fluid in the well bore is filled with a quantity of well bore fluid at ambient hydrostatic well bore pressure at the sonde depth. Periodically, a pneumatic pressure source in the sonde exerts a surge of pressure on the fluid chamber greater than ambient well bore pressure. This action causes rapid flow of fluid from the sonde chamber into the well bore and surrounding perforated formation. The pressure surge thus formed is a sudden pressure increase which further fractures the perforated formation.

In the preferred embodiment of the invention, the fluid chamber in the sonde is formed in the interior of a flexible tubular member which is mounted within a housing in the sonde between upper and lower fluid permeable cages. The upper and lower cages are provided with a plurality of ports which communicate through openings in the sonde to the ambient hydrostatic pressure in the well bore adjacent the formation of interest.

A first pneumatic pressure chamber in the sonde receives and stores a pressurized gas from the surface via a pneumatic supply line. Periodically, a pneumatic actuator in the sonde is activated, allowing a burst of pressurized gas from the first pressure chamber to rapidly surge into an annular chamber between the tubular member and the sonde housing. The rapid surge of the pressurized gas into the annular chamber collapses the tubular member, forcing the well fluid in the fluid chamber outwardly through the ports in the cages. The outwardly forced well fluid causes a sudden surge of pressure in the perforated formation adjacent the tool, thus further fracturing the formation.

At a suitable time after the pressure surge, a second solenoid-actuated valve is opened. The second valve when open permits the well fluid pressure to expand the tubular member back to a normal expanded state, forcing gas from the annular chamber into a second storage chamber. The foregoing cycle of operations may be repeated at the desired perforation in the well until the formation has been fractured sufficiently to allow desired flow of petroleum into the well bore.

DETAILED DESCRIPTION OF THE PREFERRED EMBODIMENT

Figure 1:
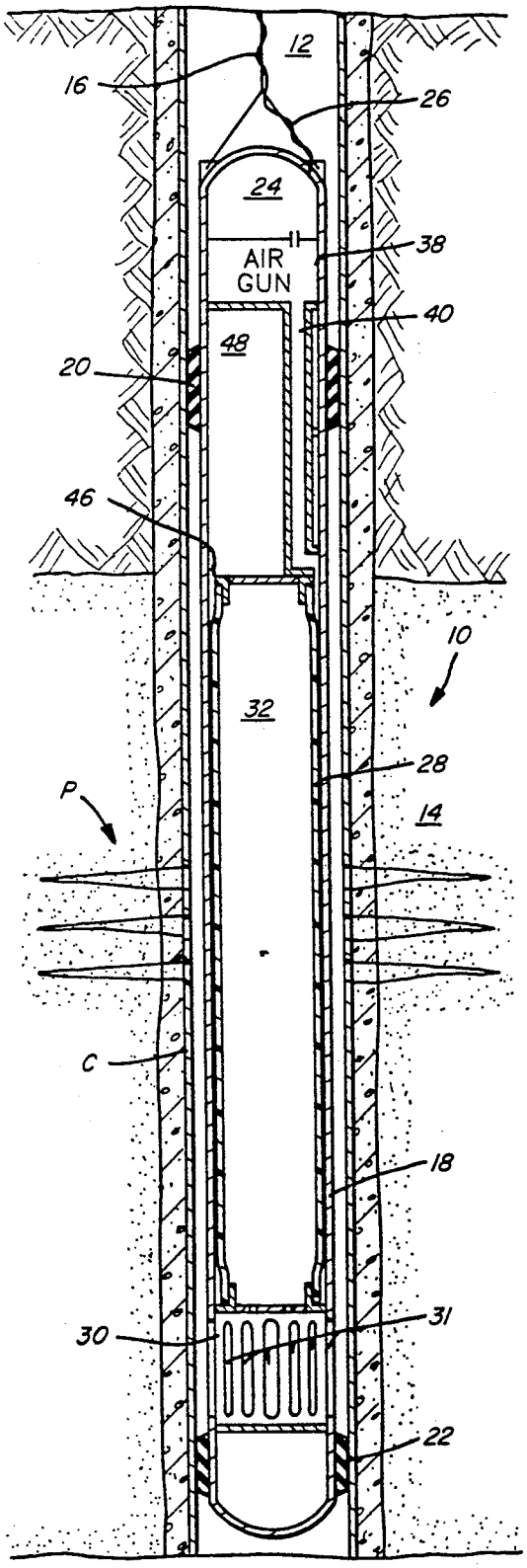
FIG. 1 is an elevation view, taken in cross-section, of a pneumatic well tool according to the present invention in a well bore before sending a pressure surge into a fractured formation.

Referring to FIG. 1, a pneumatic well tool 10 of the present invention is shown in a fluid-filled well bore 12 within a petroleum producing subsurface geologic formation 14 of interest. The well bore 12 is typically lined with a cemented casing C in the usual manner adjacent the formation 14. A suitable number of perforations P in the formation 14 and casing C have been formed using any of several conventional well perforation techniques.

The well tool 10 is lowered by a wireline 16 into the cased well bore 12 and suspended at a desired depth adjacent the formation 14. The well tool 10 comprises a generally cylindrical outer housing body or sonde 18 which is supported and held in place within the cased well bore 12 adjacent the perforations P by an upper packer assembly 20 and a lower packer assembly 22. Packer assemblies 20 and 22 are preferably inflatable wireline operated packers. They may be of any of several suitable conventional types available in the petroleum industry to isolate the well tool 10 from the casing C.

A reservoir of pressurized gas is stored in an upper pneumatic pressure chamber 24 which receives pressurized gas from a compressor at the surface via a pneumatic supply line 26. The pressurized gas from the surface may be air, nitrogen or some other inert gas or in some instances gas produced from the formation 14, as desired. The pressure of the gas may be chosen based on several factors set forth below. A flexible tubular member 28, which is similar in structure and nature to a high pressure water hose or fire hose, is mounted within the sonde 18 above a ported cage 30. The cage 30 is provided with a suitable number of ports 31, which allow communication of fluid to and from the interior of sonde 18 and the surrounding well bore 12.

Figure 2:
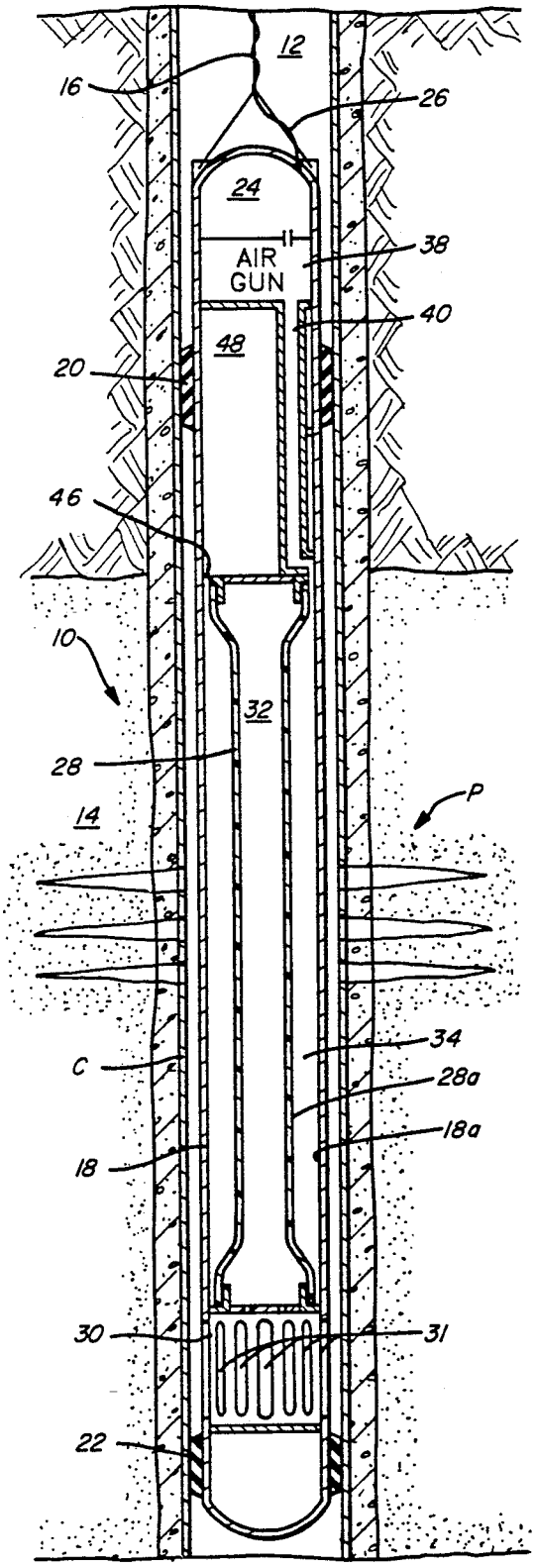
FIG. 2 is an elevation view, taken in cross-section, of the pneumatic well tool of FIG. 1 after sending a pressure surge into a fractured formation.

The interior of the tubular member 28 defines a fluid chamber 32 which is normally filled with fluid which enters through cage 30 from the well bore 12, due to the ambient hydrostatic pressure of well bore fluid at the depth of the formation 14. When the chamber 32 is filled with well bore fluid, the tubular member 28 is in a normally expanded position (FIG. 1). A space present between an outer surface 28*a* of the tubular member 28 and an inner surface 18*a* of the sonde 18 defines a variable capacity annular pneumatic pressure chamber 34, seen best in FIG. 2, for receiving pressurized gas to collapse the tubular member 28.

A pneumatic air gun 38, such as of the type used as an energy source in marine seismic exploration, is mounted in fluid communication, between the pressure chamber 24 and the annular pressure chamber 34. Periodically, the air gun 38 is activated via wireline 16, allowing a quantity of pressurized gas to surge into the annular pneumatic pressure chamber 34. The surge of the pressurized gas into annular chamber 34 collapses the tubular member 28 (FIG. 2), forcing the fluid in the chamber 32 outwardly in the well bore 12 through the ports 31 in the cage 30. If vertical fluid movement is desired, cage 30 with ports 31 may be replaced with a sleeve member having no ports and the lower portion of sonde 18 left open for vertical fluid passage in the well bore.

The firing rate and pressure at which gas passes from the air gun 38 to collapse tubular member 28 and the volume of such gas are dependent on several interrelated factors. One factor is the nature and condition of the formation 14 and the perforations P in it. Another is the ambient hydrostatic fluid pressure in well bore 12. Yet another is the volume available for gas in annular chamber 34. Still another is the discharge pressure capacity and volume rate for the air gun 38. It is thus a combined function based on knowledge of geologic and fluid dynamic conditions and considerations.

This movement of fluid into well bore 12 through the sonde ports 31 may be selected so that it causes a sudden surge of pressure in the fluid in perforations P of the formation 14 adjacent the tool 10. Alternatively, the movement of fluid may be chosen so that it is a pressure increase to a relatively high pressure on the formation 14. This high pressure can then be quickly abated, causing a suction-like action on materials and fluid in the perforation P. The impulse formed in the foregoing manner in the air gun 38 may be controlled to thus be either an implosion or explosion as desired. In either case, well tool 10 serves to increase the ability of formation fluid flow through the perforations P in the formation 14 into the well bore 12.

At a suitable time after each pressure surge, gas present in the annular chamber 34 is forced by the hydrostatic pressure of fluid in well bore 12 to flow through a tube or channel 46 into a second pressure chamber 48. As the pressurized gas flows out of the annular chamber 34, the fluid pressure in well bore 12 causes well bore fluid to enter the chamber 32 in flexible tubular member 28 and thereby causes it to return to its expanded position, as shown in FIG. 1.

The foregoing cycle of operations may be repeated for a desired number of cycles at one or several depths in well bore 12 to increase the fracturing of the formation rock adjacent the perforations P. The number of cycles is determined in part by the storage capacities of chambers 24 and 48.

Such a repeated number of cycles can be continued until a limit is reached. This situation generally occurs when the pressure of the gas in storage chamber 48 is substantially equal to the ambient hydrostatic fluid pressure in the well bore 12 and formation 14.

The tool 10 may then be retrieved by wire line 16 from well bore 12 and the stored pressure in chamber 48 abated at the surface. The tool 10 may then be lowered by wire line 16 again into the well bore 12 for further operating cycles.

If desired, the chamber 48 may be vented in situ while in the well bore 12. When chamber 48 is so vented, the gas used is preferably either nitrogen or an inert gas. In situations where natural gas is being produced, portions of it may be used as the pressurizing gas, if desired. Alternatively, chamber 48 may be drained by a pressure vent line to the surface. Such a pressure vent line would generally have a construction similar to pneumatic supply line 26. In some situations, such as shallow wells or low pressure situations, supply line 26 may be used to both charge chamber 24 and drain chamber 48.

Although the method and apparatus of the present invention has been described in connection with the preferred embodiment, it is not intended to be limited to the specific form set forth herein, but, on the contrary, it is intended to cover such alternatives, modifications and equivalents as can reasonably be included within the spirit and scope of the invention as defined by the appended claims.

I claim:

1. An apparatus for stimulating the flow of petroleum from a perforated subsurface formation adjacent a fluid-filled well bore, comprising:

a generally cylindrical housing body adapted to be in the well bore adjacent the subsurface formation;

means defining a fluid chamber within said housing, said means comprising a flexible tubular member supported in said housing body within an annular pressure chamber formed as a space between said tubular member and said housing body;

said fluid chamber being formed within said tubular member and in fluid communication with fluid in said well bore; and pneumatic actuation means to force fluid from said fluid chamber into the well bore and perforated formation to cause fracturing of the subsurface formation.

2. The apparatus of claim 1, wherein said pneumatic actuation means comprises:

a first pneumatic storage chamber for accumulating a reservoir of pressurized gas; and means for communicating pressurized gas from said first pneumatic storage chamber into said annular pneumatic pressure chamber to collapse said tubular member to force fluid from said fluid chamber into the well bore.

3. The apparatus of claim 2, wherein said valve means for communicating comprises:

an air gun controlling flow of pressurized gas from said first pneumatic storage chamber, and a gas flow channel conveying pressurized gas from said air gun to said annular pneumatic pressure chamber.

4. The apparatus of claim 1, further comprising:

means for escape of pressurized gas from said annular pressure chamber.

5. A method of stimulating the flow of petroleum from a perforated subsurface formation adjacent a fluid-filled well bore, comprising the steps of:

(a) positioning a fluid chamber within a well bore adjacent a formation of interest;

(b) allowing the fluid chamber to fill with a quantity of well bore fluid;

(c) forcing the well bore fluid from the fluid chamber into the well bore and the perforated subsurface formation; and fracturing the perforated subsurface formation with the well bore fluid.

6. The method of claim 5, wherein said step of forcing comprises the step of:

communicating pressurized gas to collapse the fluid chamber to force the well bore fluid from the fluid chamber into the well bore.

7. The method according to claim 6, further including the step of:

allowing the fluid chamber to refill with well bore fluid after said step of forcing.

* * * * *